US007531963B2

(12) United States Patent
Sasaki et al.

(10) Patent No.: US 7,531,963 B2
(45) Date of Patent: May 12, 2009

(54) PLASMA DISPLAY PANEL WITH INSULATION LAYER HAVING PROJECTIONS

(75) Inventors: Takashi Sasaki, Hiratsuka (JP); Takahiro Takamori, Yonago (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 360 days.

(21) Appl. No.: 11/357,119

(22) Filed: Feb. 21, 2006

(65) Prior Publication Data

US 2006/0186811 A1 Aug. 24, 2006

(30) Foreign Application Priority Data

Feb. 21, 2005 (JP) ..... 2005-043411

(51) Int. Cl.
*H01J 17/49* (2006.01)
*G09G 3/10* (2006.01)
*G09G 3/28* (2006.01)

(52) U.S. Cl. ..... 313/586; 313/582; 313/584; 315/169.1; 315/169.3; 345/67

(58) Field of Classification Search ..... None
See application file for complete search history.

(56) References Cited

U.S. PATENT DOCUMENTS 6,450,849 B1 9/2002 Harada
6,534,915 B2 3/2003 Amemiya
2003/0080683 A1 * 5/2003 Inoue et al. ..... 313/586
2003/0197468 A1 10/2003 Shibata et al.

FOREIGN PATENT DOCUMENTS

JP 10-308177 11/1998
JP 2000-21304 1/2000
JP 2001-216902 8/2001
JP 2003-308784 10/2003

OTHER PUBLICATIONS

Korean Patent Office Action, mailed Dec. 4, 2006, and issued in corresponding Korean Patent Application No. 10-2006-0012337.

* cited by examiner

*Primary Examiner*—Sikha Roy
*Assistant Examiner*—Tracie Y Green
(74) *Attorney, Agent, or Firm*—Staas & Halsey LLP

(57) ABSTRACT

An insulation layer covering segment layers and a plurality of row electrodes arranged on a first substrate has, on its surface, first projections and second projections. The first projections have a shape and a height corresponding to those of the row electrode, and contacts partitions disposed on a second substrate. The second projections have a shape and a height corresponding to those of the segment layer. The partitions and the second projections constitute discharge barriers between columns, which prevents discharge interference from occurring between cells along the row electrodes.

9 Claims, 4 Drawing Sheets

PLASMA DISPLAY PANEL WITH INSULATION LAYER HAVING PROJECTIONS

BACKGROUND OF THE INVENTION

1. Field of the Invention

The present invention relates to plasma display panels including projections that are generated, along electrodes, on a surface of an insulation layer for covering the electrodes.

2. Description of the Related Art

An AC type plasma display panel includes a dielectric layer for covering display electrodes. The dielectric layer is formed on a substrate on which the display electrodes are arranged in a manner to extend over the entire screen. The dielectric layer that is made of low melting point glass, which is a general material, has a thickness of approximately 20 μm to 30 μm. A protection film is deposited on a surface of the dielectric layer. The protection film has a thickness of approximately 0.5 μm to 1 μm and serves to prevent sputtering due to discharges for the dielectric layer. Stated differently, the display electrodes are covered with a layered film including the dielectric layer and the protection film for a discharge gas space. The layered film including the dielectric layer and the protection film is herein referred to as an insulation layer.

A vapor deposition method (also called a vapor growth method) has recently received attention as a method for forming dielectric layers. Japanese unexamined patent publication No. 2000-21304 describes forming a dielectric layer made from silicon dioxide or organic silicon oxide using plasma CVD (Chemical Vapor Deposition) that is one kind of chemical vapor deposition method. The vapor deposition method enables provision of a thin dielectric layer having a uniform thickness. Further, the vapor deposition method makes it possible to form a dielectric layer with a low relative dielectric constant that is favorable to reduction of interelectrode capacitance at temperatures lower than a burning temperature of low melting point glass.

Layers obtained by the vapor deposition method have a structural feature in which a surface is uneven due to reflection of irregularities of a foundation surface (a surface on which layers are formed). More specifically, surfaces of layers obtained by the vapor deposition method are not even unlike a surface of a low melting point glass layer that is burned at sufficiently high temperatures. A dielectric layer is formed on a substrate on which display electrodes are arranged. Accordingly, a dielectric layer obtained by the vapor deposition method has an uneven surface in which portions corresponding to the display electrodes bulge out compared to the other portions by amounts corresponding to the thickness of the display electrodes. Since a protection film formed on the uneven surface is sufficiently thin, the surface of the protection film, i.e., a surface of an insulation layer is similarly uneven.

In a surface discharge AC type plasma display panel suitable for color picture display, partitions as discharge barriers are arranged on a second substrate that faces a first substrate on which display electrodes and an insulation layer are arranged. Partition arrangement patterns include a stripe pattern in which a discharge gas space is divided on a column basis of a screen and a mesh pattern in which a discharge gas space is divided on a cell basis of a screen.

The insulation layer abuts against the tops of the partitions within the plasma display panel of this type. In a state where the insulation layer abuts against the tops of the partitions, the partitions serve to prevent discharge interference among cells and function as spacers for equalizing a thickness (a dimension in the facing direction of substrates) of the discharge gas space within the screen.

Japanese unexamined patent publication No. 2000-21304 describes a structure in which projections of an insulation layer formed on a first substrate abut against a stripe-patterned partition supported by a second substrate. Further, Japanese unexamined patent publication No. 2003-308784 describes a structure in which projections of an insulation layer abut against a mesh-patterned partition.

In plasma display panels including projections that are generated, along display electrodes, on an insulation layer for covering the display electrodes, a problem arises that gaps exist between partitions and parts other than the projections in the insulation layer and discharge interference is apt to occur among adjacent cells, compared to the case of plasma display panels having an insulation layer with a flat surface.

SUMMARY OF THE INVENTION

The present invention is directed to solve the problem pointed out above, and therefore, an object of the present invention is to prevent discharge interference in plasma display panels in which partitions abut against an insulation layer on which projections are generated along display electrodes.

A plasma display panel according to one aspect of the present invention includes a first substrate, a second substrate placed in face-to-face relation with the first substrate, a plurality of row electrodes arranged on the first substrate, an insulation layer for covering the row electrodes, a plurality of partitions arranged on the second substrate, each of which is placed in a boundary between columns and is continuous over an entire length of the column, a first projection that is formed on a surface of the insulation layer and has a shape and a height corresponding to those of the row electrode, a segment layer that is positioned in a manner to overlap with the partition in the first substrate and to avoid overlap with the row electrode, the segment layer being covered with the insulation layer, and a second projection that is formed on the surface of the insulation layer, has a shape and a height corresponding to those of the segment layer and constitutes a part of a discharge barrier between the columns.

In the present invention, the second projections are formed on the surface of the insulation layer in addition to the first projections along the row electrodes, which causes gaps between the partitions and parts other than the projections to narrow. For the purpose of providing the second projections, segment layers corresponding to the second projections are positioned on a surface on which the row electrodes are formed prior to formation of the insulation layer.

Preferably, the segment layers are made from materials that are the same as those of the row electrodes. The row electrodes and the segment layers are formed at the same time, followed by formation of the insulation layer, which eliminates the need for a specific step for providing the second projections. In the case where the row electrodes have a multilayered structure, the segment layers may have the same structure as that of the row electrodes or may have a structure in which the number of layers is smaller than the number of layers of the row electrodes. In either structure, the fact remains that a specific step is unnecessary to provide the second projections.

The present invention can prevent discharge interference in plasma display panels in which partitions abut against an insulation layer on which projections are generated along display electrodes.

The present invention makes it unnecessary to perform a specific step for providing the second projections.

These and other characteristics and objects of the present invention will become more apparent by the following descriptions of preferred embodiments with reference to drawings.

DESCRIPTION OF THE PREFERRED EMBODIMENTS

The present invention is suitably applied to plasma display panels for color display. The following is a description of a case of a three-electrode surface discharge AC type plasma display panel having a screen including many cells.

Figure 1:
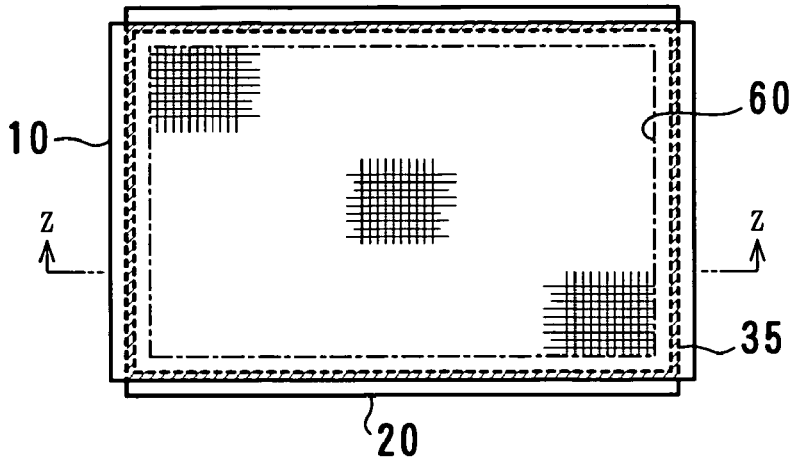
FIG. 1 is a front view showing the entire structure of a plasma display panel.
Figure 2:
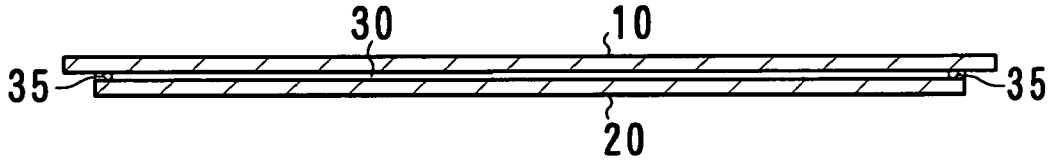
FIG. 2 is a cross-sectional cut along z-z line in FIG. 1.

A basic structure of a plasma display panel is shown in FIGS. 1 and 2 respectively. FIG. 1 is a front view showing the entire structure of the plasma display panel, and FIG. 2 is a cross-sectional cut along z-z line in FIG. 1. The plasma display panel includes a front panel 10, a rear panel 20 and a screen 60 made up of cells (light emission elements) arranged in a matrix. In the case where the screen 60 is a 42-inch diagonal, for example, the plasma display has dimensions of approximately 994 mm×585 mm. Each of the front panel 10 and the rear panel 20 is a structure including a glass substrate on which electrodes and other structural elements are fixed. Both the glass substrates have a size larger than the screen 60 and a thickness of approximately 3 mm. The front panel 10 and the rear panel 20 are positioned one above the other to assemble in face-to-face relation with each other. The front panel 10 and the rear panel 20 are bonded together with a sealing material 35 that has a frame shape in a plan view and is placed in the periphery of the area where the two panels overlap with each other. The front panel 10 projects over the rear panel 20 by approximately 5 mm in the lateral direction of FIG. 1. The rear panel 20 projects over the front panel 10 by approximately 5 mm in the vertical direction of FIG. 1. A flexible wiring board for electrical connection to a drive unit is joined to respective end portions of the front panel 10 and the rear panel 20 that project as described above. An internal space (a discharge gas space) 30 that is sealed by the front panel 10, the rear panel 20 and the sealing material 35 is filled with a discharge gas that is a mixture of neon and xenon. A thickness value of the discharge gas space 30 (a distance between the front panel 10 and the rear panel 20) falls within the range of 100 μm through 200 μm.

Figure 3:
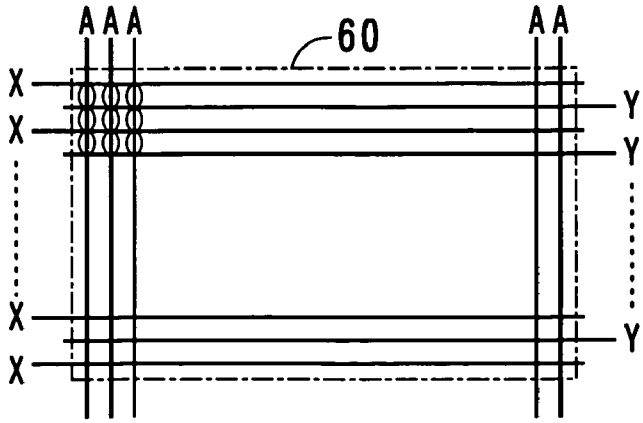
FIG. 3 is a diagram showing an example of electrode arrangement.

An example of electrode arrangement is shown in FIG. 3. Referring to the illustrated electrode arrangement, row electrodes are arranged at regular intervals and such electrode arrangement is suitable for high-resolution display. On the screen 60 are arranged display electrodes X and display electrodes Y, both of which are row electrodes, and address electrodes that are column electrodes. The display electrodes X and the display electrodes Y are alternately arranged in the order of "X, Y, X, Y, . . . X, Y and X". Further, the display electrodes X and the display electrodes Y are arranged in parallel with each other. A set of a display electrode X and a display electrode Y adjacent thereto defines one row. Each of the display electrodes X and the display electrodes Y has relations with the neighboring two rows, except the display electrodes X placed at both ends of the arrangement. The total number of display electrodes X and display electrodes Y is a number determined by adding one to the number of rows of the screen 60. Each of the address electrodes is arranged in a manner to correspond to one column. The number of address electrodes is equal to the number of columns. The address electrodes and the display electrodes Y provide an electrode matrix for an addressing operation. Nine ellipses in FIG. 3 represent positions of cells that belong to a first column through a third column in each of a first, a second and a third rows.

Figure 4:
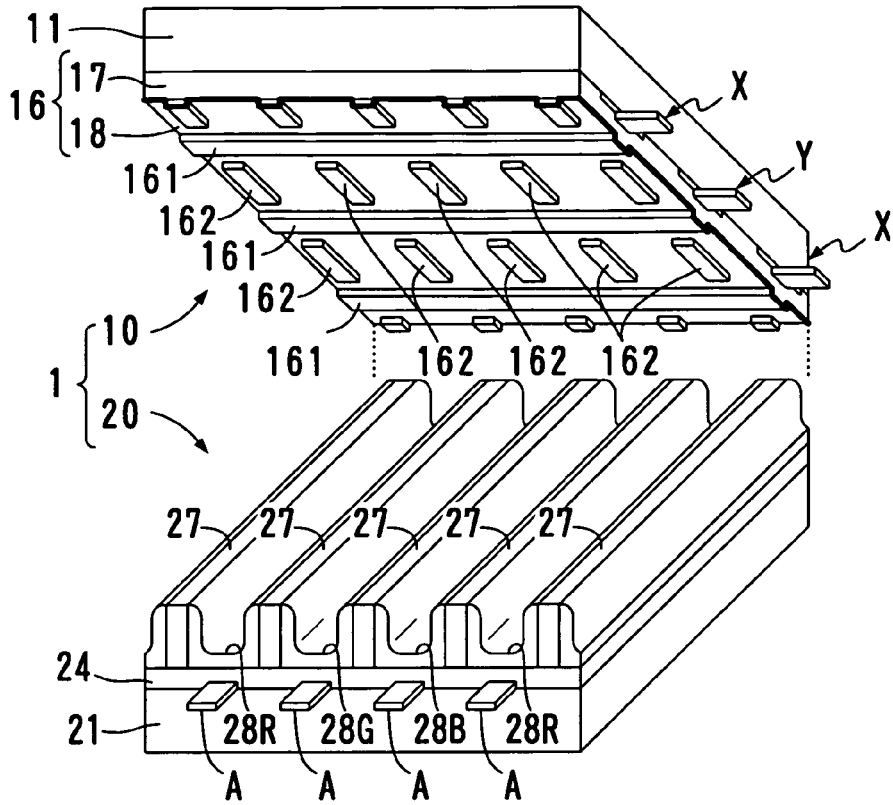
FIG. 4 is a diagram showing a cell structure of a plasma display panel according to the present invention.
Figure 5:
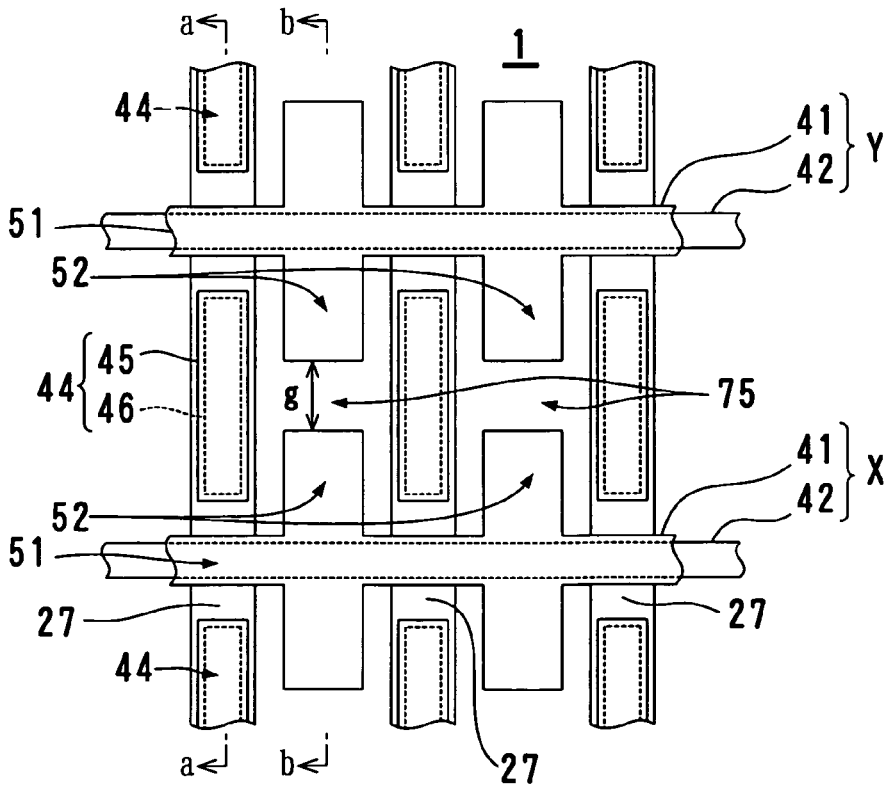
FIG. 5 shows planar shapes of display electrodes and segment layers.

FIG. 4 shows an outline of a cell structure of a plasma display panel according to the present invention and FIG. 5 shows planar shapes of display electrodes and segment layers. For easy understanding of an internal structure, FIG. 4 illustrates a cell structure with the front panel 10 being detached from the rear panel 20.

The front panel 10 of the plasma display panel 1 includes a glass substrate 11, the display electrodes X and Y and an insulation layer 16. The insulation layer 16 for covering the display electrodes X and Y is a layered film including a dielectric layer 17 and a protection film 18. The protection film 18 is a vapor-deposited film of magnesia with a thickness of approximately 0.5 μm. The insulation layer 16 has an uneven surface that reflects irregularities of a foundation surface in layer formation. The insulation layer 16 includes plural projections 161 corresponding to the metal films 42 of the display electrodes and plural projections 162 unique to the present invention. The projections 162 have a thickness and shape corresponding to segment layers that are described later.

The rear panel 20 includes a glass substrate 21, address electrodes A, a dielectric layer 24, plural partitions 27 and three types of fluorescent material layers 28R, 28G and 28B having different light emission colors. As viewed from the top, the partitions 27 are ribbon-like structures for defining boundaries between columns. The partition 27 abuts against the projections 162 and parts of the projections 161 in the insulation layer 16. These partitions 27 divide a discharge gas space on a column basis.

As shown in FIG. 5, a set of a display electrode X and a display electrode Y that are adjacent to each other across discharge gaps 75 forms an electrode pair (an anode and a cathode) for generating display discharges in the form of surface discharge. The display electrodes X and Y are arranged on the glass substrate 11. Each of the display electrodes X and Y is structurally made up of a transparent conductive film 41 and a metal film 42 that is formed thereon as shown in FIG. 5. The transparent conductive film 41 is patterned to have a ribbon shape with the width being changed regularly and the metal film 42 has a narrow ribbon shape with a constant width. The transparent conductive film 41 has a thickness of approximately several thousands Å and the metal film 42 has a thickness of approximately 2 μm through 3 μm. The metal film 42 has a thickness much greater than that of the transparent conductive film 41. Each of the display electrodes X and Y is functionally made up of a power feeding trunk portion 51 with a ribbon shape that continuously extends over the entire length of a row and discharge portions 52 that form discharge surfaces in cells in the corresponding row. Each of the discharge portions 52 extends in each column from the power feeding trunk portion 51 toward a cell center by the same width. A discharge portion 52 of a display electrode X and a discharge portion 52 of a display electrode Y adjacent thereto form a discharge gap 75. The transparent conductive film 41 can be made up of plural patterns that are arranged separately for each column instead of a ribbon shape that extends over the entire length of a row. In such a case, the power feeding trunk portion 51 is formed only by the metal film 42 and the discharge portion 52 is formed only by the transparent conductive film 41.

Referring to FIG. 5, in the plasma display panel 1, a segment layer 44 is positioned in a manner to overlap with the partition 27 in a gap between electrodes making an electrode pair and to avoid overlap with the display electrodes X and Y. The segment layer 44 is a conductive layer including a transparent conductive film 45 and a metal film 46 and has the same structure as those of the display electrodes X and Y. The segment layer 44 is patterned to be away from the display electrodes X and Y in order to prevent a short circuit between the display electrode X and the display electrode Y. However, when the segment layer 44 is made of an insulation material, it is unnecessary to distance the segment layer 44 from the display electrodes X and Y.

Figure 6:
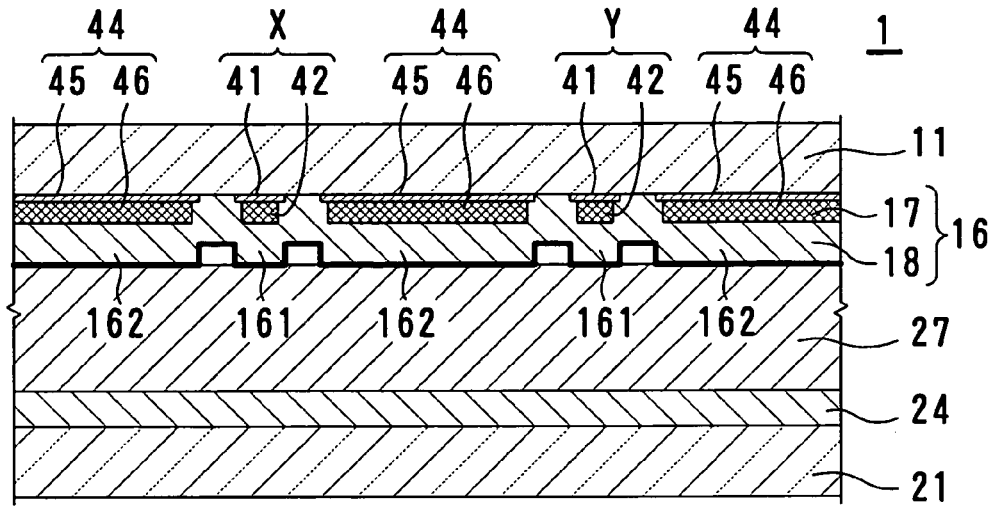
FIG. 6 shows a cross-sectional structure along a-a line in FIG. 5.
Figure 7:
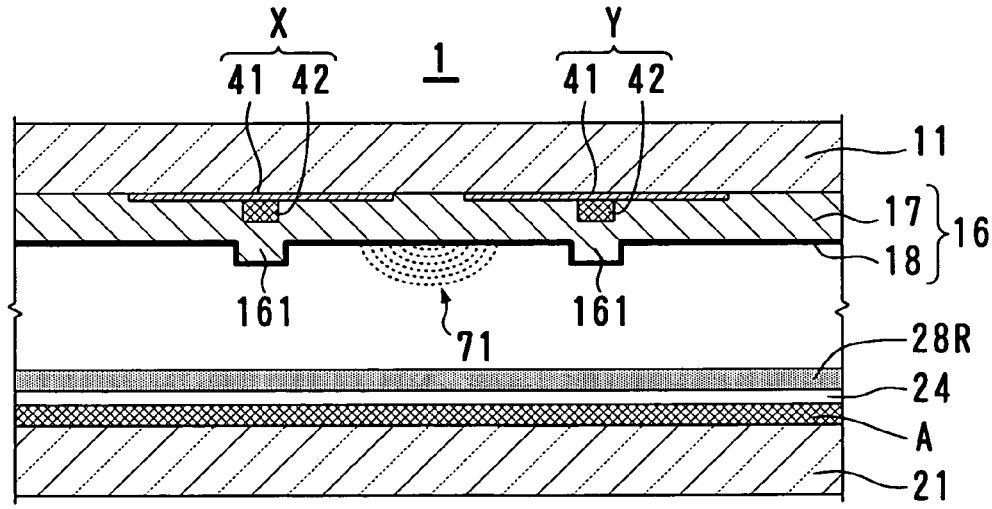
FIG. 7 shows a cross-sectional structure along b-b line in FIG. 5.

FIG. 6 shows a cross-sectional structure along a-a line in FIG. 5 and FIG. 7 shows a cross-sectional structure along b-b line in FIG. 5.

As described above, the insulation layer 16 has the first projections 161 corresponding to the metal films 42 of the display electrodes X and Y and the second projections 162 corresponding to the segment layers 44. Such a structure of the insulation layer 16 is related to a method for forming the dielectric layer 17. The use of the vapor deposition method for forming the dielectric layer 17 provides an uneven surface of the dielectric layer 17, causing the thin protection film 18 for covering the dielectric layer 17 to be uneven. Strictly speaking, while uneven parts corresponding to the transparent conductive film 41 are generated, the uneven parts have a minute value that is unnecessary to be considered. Even in the case of using a thick film process, instead of the vapor deposition method, to form the dielectric layer 17, when a leveling process is insufficient at the time of burning, the surface of the dielectric layer 17 becomes uneven. The leveling process is apt to be insufficient in the case of using low melting point glass that adapts to lead-free and has a relatively high softening point as a material for the dielectric.

As specifically shown in FIG. 7, the center of a column is a discharge gas space where a display discharge (a surface discharge) 71 is generated between the projections 161 adjacent to each other. Referring to FIG. 6, however, the second projection 162 exists between the first projections 161 adjacent thereto at a position in which the partition 27 is placed, i.e., at a boundary between columns. The second projections 162 form a discharge barrier between columns along with the partition 27 against which the second projections 162 abut. The presence of the second projections 162 eliminates almost all of the gaps between the partition 27 and the insulation layer 16 at a boundary between columns. Thereby, discharge interference among columns is less likely to occur in the plasma display panel 1.

The segment layers 44 are formed in a step for forming display electrodes. More specifically, the transparent conductive films 45 of the segment layers 44 are patterned at the same time as the transparent conductive films 41 of the display electrodes X and Y are patterned. Likewise, the metal films 46 of the segment layers 44 are patterned at the same time as patterning of the metal films 42 of the display electrodes X and Y. Then, the CVD method or the thick film process in which the leveling process is not sufficiently performed is used to form the dielectric layer 17, then to form the protection film 18. A specific step for providing the second projections 162 is unnecessary in the case of manufacturing the plasma display panel 1.

It should be noted that the layered film 44 may be formed only by the metal film 46. In such a case, the second projection 162 is lower than the first projection 161 by a thickness of the transparent conductive film. Since the height difference is very small, the second projection 162 has the effect of preventing discharge interference sufficiently.

Figure 8:
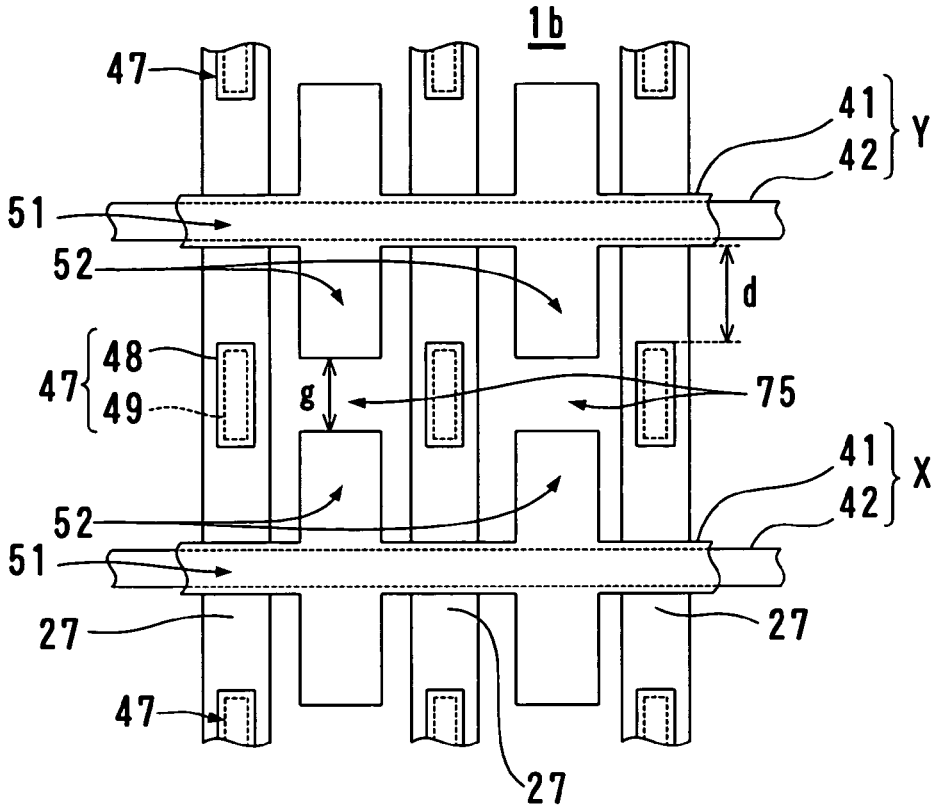
FIG. 8 shows a second example of planar shapes of segment layers.

FIG. 8 shows a second example of planar shapes of segment layers. A plasma display panel 1*b* in this example has the same structure as the plasma display panel 1 described above except for a segment layer 47.

Referring to the plasma display panel 1*b* shown in FIG. 8, similarly to the case of the plasma display panel 1, the segment layer 47 is a conductor including a transparent conductive film 48 and a metal film 49 and is positioned in a manner to overlap with the partition 27. The arrangement position of the segment layer 47 in the column direction corresponds to the discharge gap 75. In other words, the segment layer 47 is positioned just beside the discharge gap 75.

In comparison with the case of the plasma display panel 1 described above, each of the segment layers 47 is short and the distance "d" between the segment layer 47 and the display electrode X or Y is large. More specifically, the distance "d" is equal to or more than 100 μm. The large value of the distance "d" contributes to prevention of a short circuit between the display electrodes and reduction in capacitance between electrodes.

Since the segment layer 47 is positioned just beside the discharge gap 75 and is longer than the discharge gap length "g", the second projection is formed at a position closer to the discharge gap 75 in an area where the segment layer 47 overlaps with the partition 27, i.e., at a position where a discharge spreads easily. Accordingly, discharge interference is sufficiently reduced among columns in the plasma display panel 1*b* as in the case of the plasma display panel 1.

Figure 9:
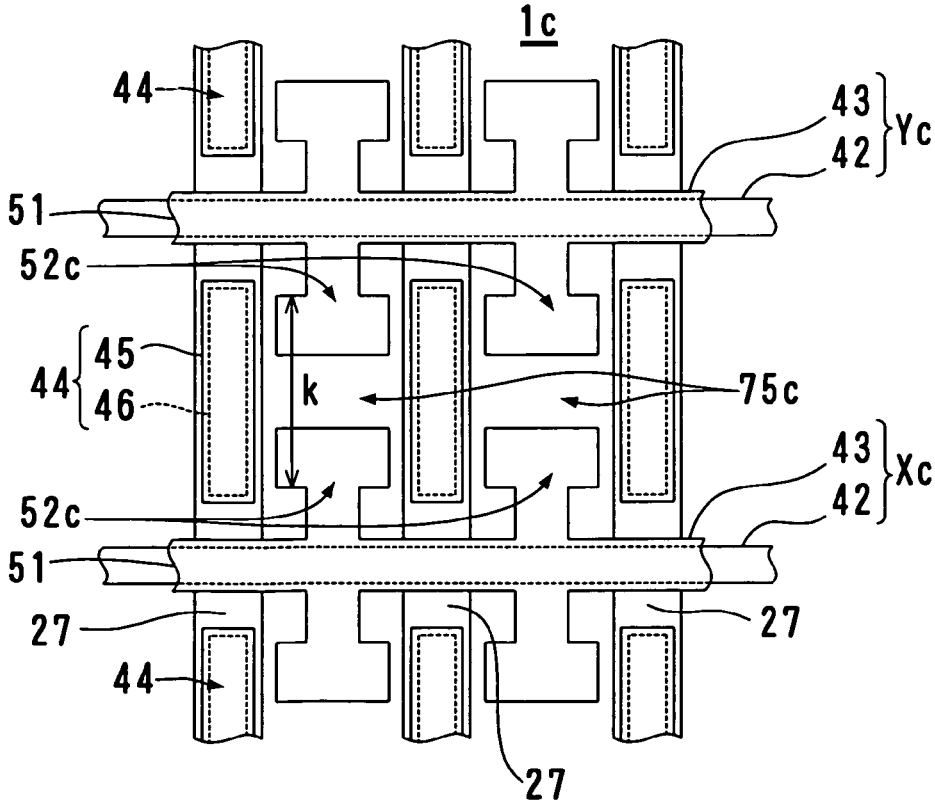
FIG. 9 shows a second example of planar shapes of display electrodes.

FIG. 9 shows a second example of planar shapes of display electrodes. A plasma display panel 1*c* in this example has the same structure as the plasma display panel 1 described above except for display electrodes Xc and Yc.

Referring to the plasma display panel 1*c* shown in FIG. 9, similarly to the case of the plasma display panels 1 and 1*b*, each of the display electrodes Xc and Yc is structurally made up of the transparent conductive film 43 and the metal film 42 formed thereon. The transparent conductive film 43 is patterned to have a ribbon shape with the width being changed regularly. The ribbon shape includes a narrow pattern that is to be a foundation of the metal film 42. Each of the display electrodes Xc and Yc is functionally made up of a power feeding trunk portion 51 with a ribbon shape that continuously extends over the entire length of a row and discharge portions 52*c* that form discharge surfaces in cells in the corresponding row. The power feeding trunk portion 51 is made up of a narrow pattern part of the transparent conductive film 43 and the metal film 42. The discharge portion 52*c* is made up of the transparent conductive film 43. Each of the discharge portions 52*c* is formed to extend in each column from the power feeding trunk portion 51 toward a cell center. Each of the discharge portions 52*c* has a T-shape, as viewed from the top, including a wide pattern that is close to a discharge gap 75*c* and a narrow pattern that connects the wide pattern to the power feeding trunk portion 51. The transparent conductive film 43 can be made up of plural patterns that are arranged separately for each column instead of a ribbon shape that extends over the entire length of a row.

The arrangement position of the segment layer 44 in the column direction corresponds to the discharge gap 75*c*. More specifically, the segment layer 44 is positioned just beside the discharge gap 75*c*. The segment layer 44 has a length greater than the distance "k" between the narrow pattern parts of the discharge portions 52*c* in a display electrode pair. Stated differently, the segment layer 44 is positioned so that the second projection 162 (see FIG. 6) is formed to face the discharge gap 75*c* and a part of the discharge portion 52*c* that is close to the partition 27.

In the embodiments discussed above, the partition pattern is a stripe pattern in which a discharge gas space is divided on a column basis. The partition pattern may be a mesh pattern in which a discharge gas space is divided on a cell basis. In such a case, instead of the plural partitions 27, a partition with a grid-like shape as viewed from the top is arranged on a screen. In the partition of this type, plural vertical walls for defining boundaries between columns are integral with plural horizontal walls for defining boundaries between rows. It should be noted here that the "partitions" according to the present invention mean vertical walls of the partition with a grid-like shape because the second projections 162 unique to the present invention constitute discharge barriers between columns.

The foregoing is a description of the structure in which the display electrodes X and Y or the display electrodes Xc and Yc are arranged on a front side substrate, what is called a reflective structure. The present invention, however, can apply to a transmissive structure in which fluorescent materials are arranged on a front side substrate and display electrodes X and Y or display electrodes Xc or Yc are arranged on a rear side substrate. In the transmissive structure, the display electrodes X and Y or the display electrodes Xc and Yc in their entirety may be made of metal.

The present invention contributes to performance improvement of display devices.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A plasma display panel comprising:

a first substrate;

a second substrate placed in face-to-face relation with the first substrate;

a plurality of row electrodes arranged on the first substrate;

a plurality of partitions arranged on the second substrate, each of which is placed in a boundary between columns and is continuous over an entire length of the column;

a plurality of segment layers disposed on the first substrate in a manner to overlap with the partition and to avoid overlapping with the row electrodes; and an insulation layer covering the row electrodes and the segment layers, the insulation layer including, on a surface thereof, first projections having a shape and a height corresponding to those of the row electrodes, and the second projections having a shape and a height corresponding to those of the segment layers, the partitions and the second projections providing a discharge barrier between the columns.

2. The plasma display panel according to claim 1, wherein the segment layer is a conductor made from a material that is identical to that of the row electrode and the segment layer is not electrically connected to the row electrode.

3. The plasma display panel according to claim 2, wherein a distance between the segment layer and the row electrode is equal to or more than 100 um.

4. The plasma display panel according to claim 2, wherein the row electrode is a layered film including a transparent conductive film and metal film that has a thickness greater than that of the transparent conductive film, and the segment layer is a layered film having a structure that is identical to that of the row electrode.

5. The plasma display panel according to claim 2, wherein the row electrode is a layered film including a transparent conductive film and a metal film that has a thickness greater than that of the transparent conductive film, and the segment layer is made from a substance that is identical to that of the metal film and has a thickness equal to that of the material film.

6. The plasma display panel according to claim 2, wherein the row electrode has a ribbon shape in which a part overlapping with the partition has a width smaller than that of a part functioning as a discharge surface between adjacent electrodes and the row electrode and an adjacent row electrode make an electrode pair for a surface discharge, and the segment layer is positioned along a column direction in a manner to correspond to a discharge gap between the parts functioning as the discharge surfaces of the electrode pair and the segment layer has a length greater than a discharge gap length.

7. The plasma display panel according to claim 6, wherein the part of the row electrode that functions as the discharge surface has a T-pattern including a wide pattern close to the discharge gap and a narrow pattern connected to the wide pattern, and the segment layer has a length greater than a distance between the narrow patterns of the electrode pair.

8. The plasma display panel according to claim 1, wherein the insulation layer is a layer formed by using a vapor deposition method.

9. A plasma display panel comprising:

a first substrate;

a second substrate placed in face-to-face relation with the first substrate;

a plurality of row electrodes arranged on the first substrate;

an insulation layer for covering the row electrodes;

a plurality of partitions arranged on the second substrate, each of which is placed in a boundary between columns and is continuous over an entire length of the column;

a first projection that is formed on a surface of the insulation layer and has a shape and a height corresponding to those of the row electrode;

a segment layer that is positioned in a manner to overlap with the partition in the first substrate and to avoid overlap with the row electrode, the segment layer being covered with the insulation layer; and a second projection that is formed on the surface of the insulation layer, has a shape and a height corresponding to those of the segment layer and constitutes a part of a discharge barrier between the columns;

wherein the segment layer is a conductor made from a material that is identical to that of the row electrode and the segment layer is not electrically connected to the row electrode; and a distance between the segment layer and the row electrode is equal to or more than 100 um.

* * * * *

UNITED STATES PATENT AND TRADEMARK OFFICE

CERTIFICATE OF CORRECTION

PATENT NO. : 7,531,963 B2
APPLICATION NO. : 11/357119
DATED : May 12, 2009
INVENTOR(S) : Takashi Sasaki et al.

It is certified that error appears in the above-identified patent and that said Letters Patent is hereby corrected as shown below:

Column 7, Line 66, change “and the” to --and--.

Column 8, Line 10, change “um.” to --μm.--.

Column 8, Line 13, change “and metal film” to --and a metal film--.

Column 10, Line 2, change “um.” to --μm.--.

Signed and Sealed this

Eighth Day of September, 2009

David J. Kappos

David J. Kappos
*Director of the United States Patent and Trademark Office*